US010905921B1

(12) United States Patent
Stubben et al.

(10) Patent No.: US 10,905,921 B1
(45) Date of Patent: Feb. 2, 2021

(54) GOLF CLUB FACE INSERT

(71) Applicant: Callaway Golf Company, Carlsbad, CA (US)

(72) Inventors: Eric D. Stubben, Encinitas, CA (US); David Handy, Carlsbad, CA (US); Patrick Dawson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/912,448

(22) Filed: Jun. 25, 2020

Related U.S. Application Data

(63) Continuation-in-part of application No. 16/902,222, filed on Jun. 15, 2020, now Pat. No. 10,821,333, which is a continuation of application No. 16/601,404, filed on Oct. 14, 2019, now Pat. No. 10,688,349, which is a continuation-in-part of application No. 16/370,685, filed on Mar. 29, 2019, now Pat. No. 10,456,634, which is a continuation of application No. 16/059,898, filed on Aug. 9, 2018, now Pat. No. 10,245,476, which is a continuation of application No. 15/796,431, filed on Oct. 27, 2017, now Pat. No. 10,052,529.

(51) Int. Cl.
*A63B 53/04* (2015.01)
*A63B 53/00* (2015.01)
*A63B 60/50* (2015.01)

(52) U.S. Cl.
CPC ..... *A63B 53/04* (2013.01); *A63B 53/007* (2013.01); *A63B 53/0487* (2013.01); *A63B 53/0408* (2020.08); *A63B 53/0416* (2020.08); *A63B 53/0445* (2020.08); *A63B 60/50* (2015.10); *A63B 2209/00* (2013.01)

(58) Field of Classification Search
CPC ... A63B 53/04; A63B 53/007; A63B 53/0487; A63B 53/0445; A63B 60/50; A63B 53/0408; A63B 53/0416; A63B 2209/00
USPC ..... 473/324–350, 287–292
See application file for complete search history.

(56) References Cited

U.S. PATENT DOCUMENTS 5,505,453 A * 4/1996 Mack ..... A63B 53/0466 473/329
5,766,094 A * 6/1998 Mahaffey ..... A63B 53/047 473/342
6,200,229 B1 * 3/2001 Grace ..... A63B 53/0487 473/324
6,699,140 B1 * 3/2004 Sun ..... A63B 53/0487 473/252
7,278,928 B2 * 10/2007 Newman ..... A63B 53/047 473/342
7,413,517 B2 * 8/2008 Butler, Jr. ..... A63B 53/0466 473/288
7,794,333 B2 * 9/2010 Wallans ..... A63B 53/047 473/331

(Continued)

*Primary Examiner* — Sebastiano Passaniti
(74) *Attorney, Agent, or Firm* — Rebecca Hanovice; Michael Catania; Sonia Lari

(57) ABSTRACT

A face insert for a golf club head, preferably a putter head, is disclosed herein. The face insert comprises a pair of stacked plates, each with a plurality of hinge features. The hinge features of the lower plate extend through openings in the upper plate so that the plates are locked together, and the edge surfaces of the hinge features combine to create a striking surface that increases topspin of a golf ball.

20 Claims, 4 Drawing Sheets

(56) References Cited

U.S. PATENT DOCUMENTS

| | | | | |
|---|---|---|---|---|
| 7,824,278 | B2 * | 11/2010 | Miyamichi | A63B 53/0487 473/329 |
| 7,846,039 | B2 * | 12/2010 | Gilbert | A63B 60/00 473/331 |
| 7,942,757 | B2 * | 5/2011 | Blumenkrantz | A63B 53/047 473/331 |
| 8,109,841 | B2 * | 2/2012 | Miyamichi | A63B 53/0487 473/340 |
| 8,292,754 | B2 * | 10/2012 | Snyder | A63B 53/04 473/251 |
| 8,371,958 | B2 * | 2/2013 | Treadwell | A63B 53/04 473/331 |
| 8,449,406 | B1 * | 5/2013 | Frame | A63B 53/047 473/329 |
| 8,545,343 | B2 * | 10/2013 | Boyd | A63B 53/04 473/288 |
| 9,776,051 | B1 * | 10/2017 | Abbott | A63B 53/0487 |
| 9,981,161 | B2 * | 5/2018 | Abbott | A63B 60/50 |
| 10,052,529 | B1 * | 8/2018 | Abbott | A63B 53/0487 |
| 10,245,476 | B2 * | 4/2019 | Abbott | A63B 53/007 |
| 10,456,634 | B2 * | 10/2019 | Abbott | A63B 53/04 |
| 10,688,349 | B2 * | 6/2020 | Stubben | A63B 53/0487 |
| 10,780,325 | B2 * | 9/2020 | Abbott | A63B 53/007 |
| 10,821,333 | B2 * | 11/2020 | Stubben | A63B 53/0425 |
| 2005/0020378 | A1 * | 1/2005 | Krumme | A63B 53/047 473/332 |
| 2011/0281665 | A1 * | 11/2011 | Kawaguchi | A63B 53/047 473/331 |

* cited by examiner

GOLF CLUB FACE INSERT

CROSS REFERENCES TO RELATED APPLICATIONS

The present application is a continuation-in-part of U.S. patent application Ser. No. 16/902,222, filed on Jun. 16, 2019, which is a continuation of U.S. patent application Ser. No. 16/601,404, filed on Oct. 14, 2019, and issued on Jun. 23, 2020, as U.S. Pat. No. 10,688,349, which is a continuation-in-part of U.S. patent application Ser. No. 16/370,685, filed on Mar. 29, 2019, and issued on Oct. 29, 2019, as U.S. Pat. No. 10,456,634, which is a continuation of U.S. patent application Ser. No. 16/059,898, filed on Aug. 9, 2018, and issued on Apr. 2, 2019, as U.S. Pat. No. 10,245,476, which is a continuation of U.S. patent application Ser. No. 15/796,431, filed on Oct. 27, 2017, and issued on Aug. 21, 2018, as U.S. Pat. No. 10,052,529, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club face insert with at least two, interlocking striking sheets, each comprising a plurality of hinge features extending from and disposed across the striking sheets, each hinge feature including a tab portion suspended over a through-opening, and one or more of the hinge features of one of the striking sheets extending through one or more of the through-openings of the other striking sheet. The sides of the tab portions combine to form a striking surface that improves topspin off the face after impact with a golf ball.

Description of the Related Art

The prior art discloses many different types of face inserts for golf club heads, including putters, that are intended to improve face performance. For example, U.S. Pat. No. 7,278,928 discloses a striking face with a plurality of solid geometric protrusions, U.S. Pat. No. 7,824,278 discloses a putter face with a plurality of pillar-shaped bodies made of a material having a higher rigidity than a golf ball, U.S. Pat. No. 8,109,841 discloses a face with a plurality of microscopic protrusions having a stiffness higher than that of a golf ball, and U.S. Pat. No. 8,371,958 discloses a golf club face with a plurality of pyramidal shaped extensions protruding therefrom. There is, however, still a need for a putter face that optimizes performance and improves topspin off of the face.

BRIEF SUMMARY OF THE INVENTION

The present invention is directed to putter face technology that improves topspin off of the face and provides consistent performance, both for sound and feel, across the face.

One aspect of the present invention is a putter comprising a body comprising a top portion, a sole portion, a toe side, a heel side, and a face side with a recess, and a face insert comprising a first striking plate and a second striking plate, wherein the first striking plate comprises a first base portion, a first plurality of hinge features extending at a first angle from the first base portion, and a first plurality of through-holes, and wherein each hinge feature of the first plurality of hinge features is disposed proximate to, and extends partially over, a through-hole of the first plurality of through-holes, wherein the second striking plate comprises a second base portion, a second plurality of hinge features extending at a second angle from the second base portion, and a second plurality of through-holes, and wherein each hinge feature of the second plurality of hinge features is disposed proximate to, and extends partially over, a through-hole of the second plurality of through-holes, wherein the first striking plate is stacked on the second striking plate so that at least a portion of the first base portion makes contact with at least a portion of the second base portion, so that each through-hole of the first plurality of through-holes at least partially overlaps a through-hole of the second plurality of through-holes, and so that each hinge of the second plurality of hinge features extends through a through-hole of the plurality of first through-holes, and wherein the face insert is disposed within the recess so that at least a portion of each hinge of the first and second pluralities of hinge features is exposed.

In some embodiments, the face insert may further comprise a backing portion, which may contact a rear surface of the first base portion. In a further embodiment, the backing portion may be affixed to and cover at least a portion of the first base portion and the second base portion. In another embodiment, each hinge feature of the first plurality of hinge features may comprise a first tab portion with a first upper surface, a first lower surface, and a first connecting surface, the first connecting surface may be approximately parallel with the first base portion, and each hinge feature of the second plurality of hinge features may comprise a second tab portion with a second upper surface, a second lower surface, and a second connecting surface, and the second connecting surface may be approximately parallel with the second base portion. In a further embodiment, the first connecting surface may be approximately parallel with the second connecting surface, and in a further embodiment, each first and second connecting surface may align with one another to create an approximately planar striking surface.

In an alternative embodiment, each of the first and second tab portions may have an approximately trapezoidal shape. In another embodiment, each hinge feature of the first plurality of hinge features may extend at a first angle of 45-90° from the first base portion, and each hinge feature of the second plurality of hinge features may extend at a second angle of 45-90° from the second base portion. In a further embodiment, the first angle may be equivalent to the second angle, and in another further embodiment, each of the first and second angle may be 54-57°.

In other embodiments, each hinge feature of the first plurality of hinge features may comprise a notch extending into the upper surface of the tab portion at an intersection between the tab portion and the first base portion. In still other embodiments, each hinge feature of the second plurality of hinge features may comprise a notch extending into the upper surface of the tab portion at an intersection between the tab portion and the second base portion.

Another aspect of the present invention is a putter comprising a body comprising a top portion, a sole portion, a toe side, a heel side, and a face side with a recess, and a face insert comprising a first metal striking plate, a second metal striking plate, and a polymeric backing portion, wherein the first metal striking plate comprises a first base portion, a first plurality of hinge features extending at a first angle from the first base portion, and a first plurality of through-holes, and wherein each hinge feature of the first plurality of hinge features is disposed proximate to, and extends partially over, a through-hole of the first plurality of through-holes, wherein the second metal striking plate comprises a second base portion, a second plurality of hinge features extending at a second angle from the second base portion, and a second plurality of through-holes, and wherein each hinge feature of the second plurality of hinge features is disposed proximate to, and extends partially over, a through-hole of the second plurality of through-holes, wherein the first striking plate is stacked on the second striking plate so that at least a portion of the first base portion makes contact with at least a portion of the second base portion, so that each through-hole of the first plurality of through-holes overlaps a through-hole of the second plurality of through-holes, and so that each hinge of the second plurality of hinge features extends through a through-hole of the plurality of first through-holes, wherein each hinge feature of the first plurality of hinge features comprises a first tab portion with a first upper surface, a first lower surface, and a first connecting surface, wherein the first connecting surface is approximately parallel with the first base portion, wherein each hinge feature of the second plurality of hinge features comprises a second tab portion with a second upper surface, a second lower surface, and a second connecting surface, wherein the second connecting surface is approximately parallel with the second base portion, wherein each first and second connecting surface aligns with one another to create an approximately planar striking surface, and wherein the face insert is disposed within the recess so that each first and second connecting surface of the plurality of first and second hinge features is exposed.

In some embodiments, the backing portion may be affixed to and cover both the first base portion and the second base portion. In another embodiment, the backing portion may be composed of a urethane material. In yet another embodiment, each hinge feature of the first and second pluralities of hinge features may be vertically spaced from adjacent hinge features by 0.005 inch to 0.010 inch and horizontally spaced from adjacent hinge features by 0.025 inch to 0.075 inch. In another embodiment, each tab portion may have a length of 0.025 inch to 0.100 inch, a width at least 1.5 times the length, and a thickness of 0.010 inch to 0.040 inch. In any of the embodiments, each of the first base portion and the second base portion may have a thickness of 0.005 inch to 0.030 inch. In still other embodiments, at least a portion of the backing portion may be flush with each first and second connecting surface. In another embodiment, each tab portion may have an approximately trapezoidal shape.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
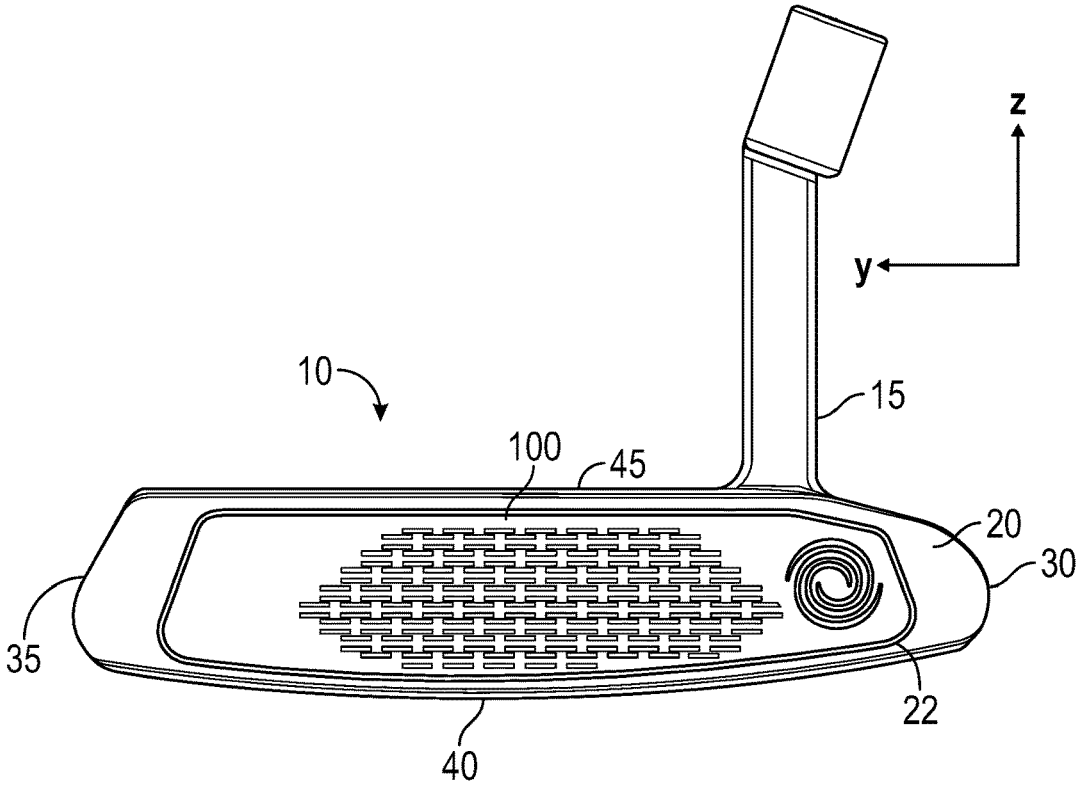
FIG. 1 is a front elevational view of an embodiment of the putter of the present invention.
Figure 2:
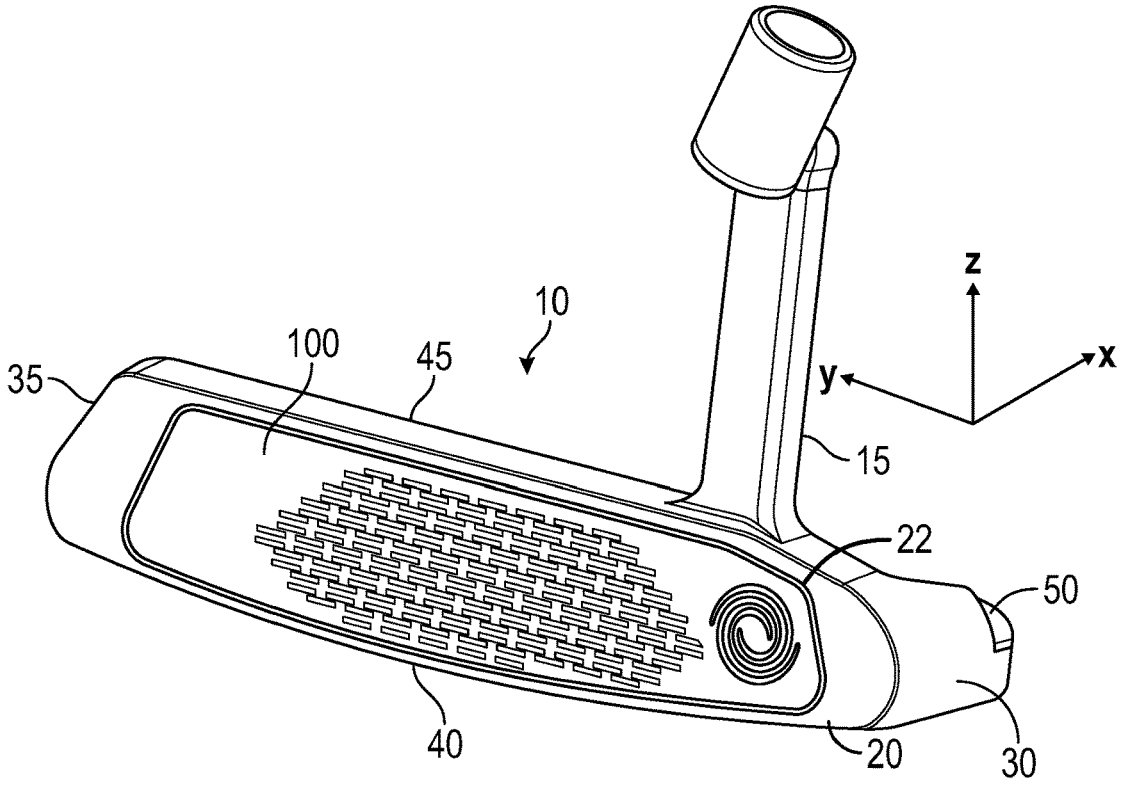
FIG. 2 is a side perspective view of the embodiment shown in FIG. 1.
Figure 3:
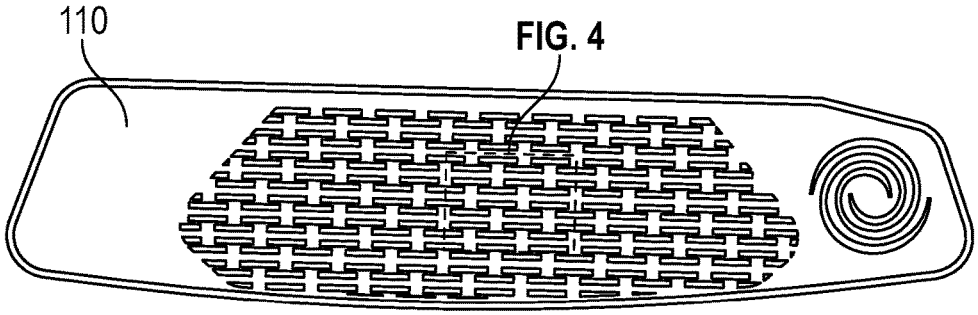
FIG. 3 is a front plan view of the face insert shown in FIG. 1.
Figure 4:
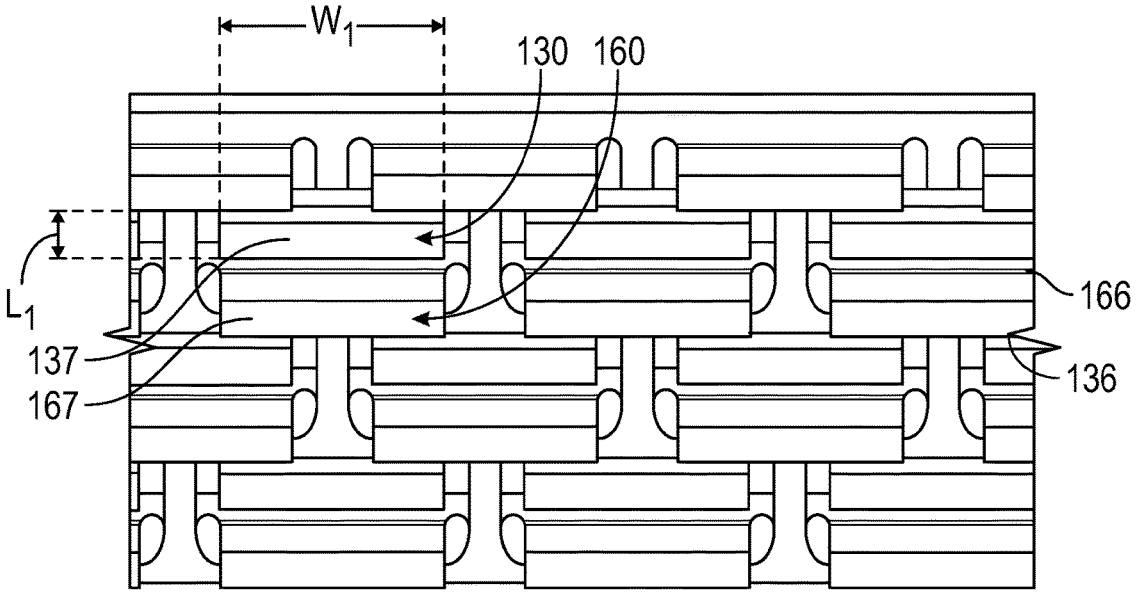
FIG. 4 is an enlarged view of the circled portion of the face insert shown in FIG. 3.

Each embodiment of the present invention is directed to a face insert 100 for a golf club head, preferably a putter head 10, which provides consistent ball speed and improved spin across the striking surface. FIG. 1 shows an exemplary putter head 10. The putter head 10 preferably comprises a hosel 15, a face 20 with a recess 22 sized to receive the face insert 100 of the present invention, a heel side 30, a toe side 35, a sole portion 40, a top portion 45, and a rear portion 50 opposite the face 20. A coordinate system is defined by a vertical z-axis extending from the sole portion 40 to the top portion 45 through the geometric center 25 of the face 20, a y-axis extending in a heel-to-toe direction parallel with the face 20 perpendicular to the z-axis, and an x-axis extending perpendicular to both the y- and z-axes from the face 20 to rear portion 50.

The preferred embodiment of the present invention is shown in FIGS. 1-10. In this embodiment, the face insert 100 comprises three parts: a backing portion 110, a first striking plate 120 comprising a first planar base portion 122 with a first plurality of through-holes 124 and a first plurality of hinge features 130, and a second striking plate 150 comprising a second planar base portion 152 with a second plurality of through-holes 154 and a second plurality of hinge features 160.

Figure 6:
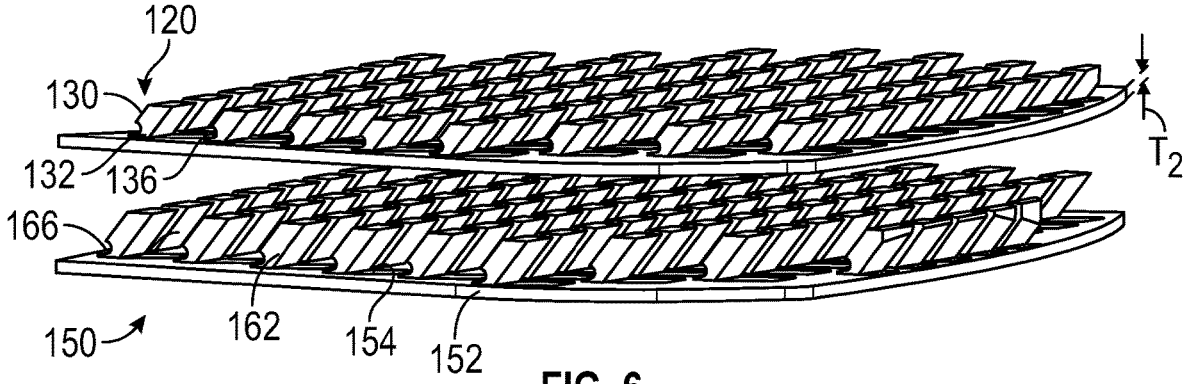
FIG. 6 is an exploded view of the striking plates shown in FIG. 5.
Figure 7:
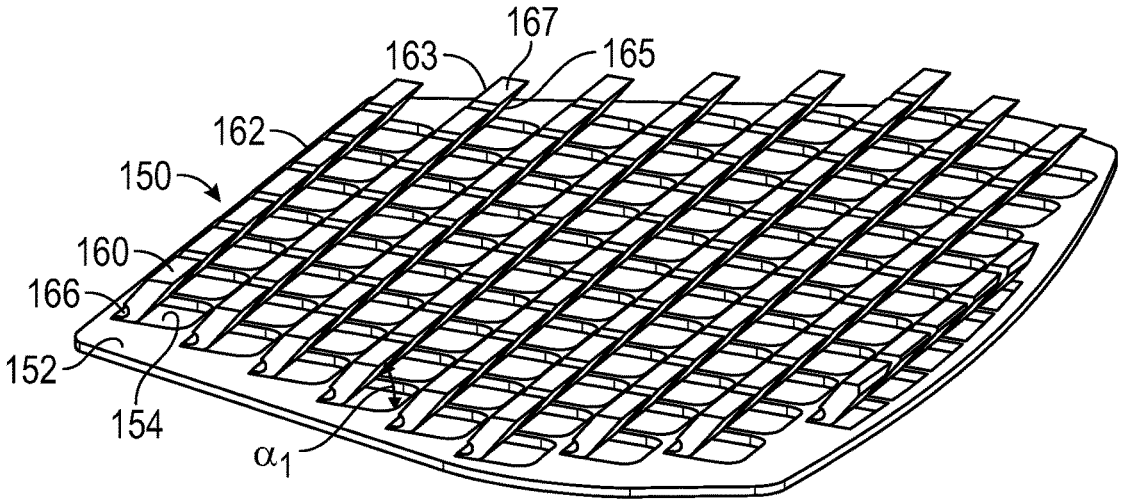
FIG. 7 is a side perspective view of the lower striking plate shown in FIG. 6.
Figure 8:
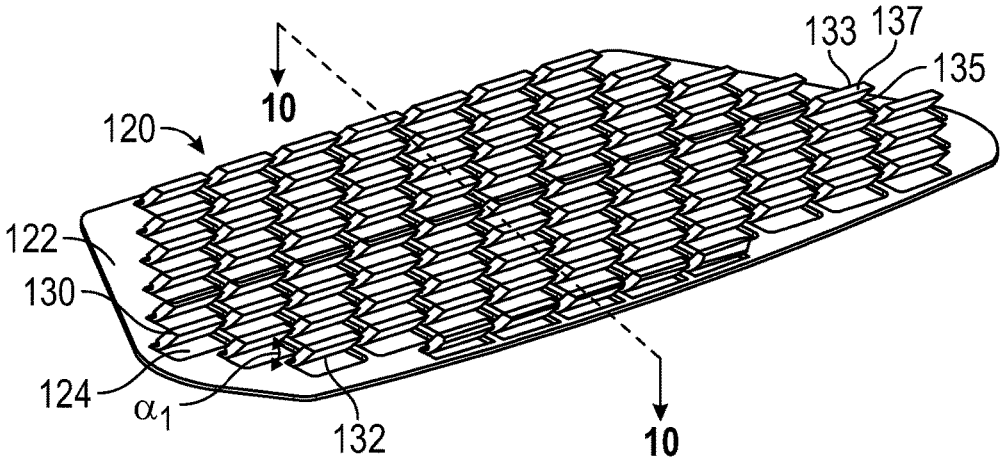
FIG. 8 is a side perspective view of the upper striking plate shown in FIG. 6.

As shown in the Figures, and particularly FIGS. 6-8, each hinge feature 130, 160 comprises a trapezoidal tab portion 132, 162 that is connected to, and extends at an angle $\alpha 1$ of 45-90° (most preferably approximately 54-57°) away from, its respective base portion 122, 152. Each tab portion 132 includes an upper surface 133, 163, a lower surface 135, 165, and a connecting surface 137, 167 that extends approximately parallel with the base portion 122, 152. Each connecting surface 137, 167 has an area of approximately 0.002-0.004 square inches. Each hinge feature 130, 160 also includes a groove or notch 136, 166 extending into the upper surface 133, 163 of the tab portion 132, 162 at the intersection between the tab portion 132, 162 and the base portion 122, 152 to facilitate movement of the hinge feature 130, 160. As shown in the Figures, each tab portion 132, 162 preferably extends partially over a through-hole 124, 154.

Each tab portion 132, 162 has a top-to-bottom (z-axis) length $L_1$ ranging from 0.025 to 0.100 inch, and more preferably approximately 0.070 inch, a heel-to-toe (y-axis) width $W_1$ that is greater than $L_1$, and more preferably at least 1.5 times $L_1$, most preferably approximately 0.182 inch, and a thickness $T_1$ of 0.010 to 0.040 inch, more preferably approximately 0.020 inch. The base portion 122, 152 of each striking plate 120, 150 preferably has a thickness $T_2$ of 0.005 inch to 0.030 inch, more preferably approximately 0.011 inch.

Figure 5:
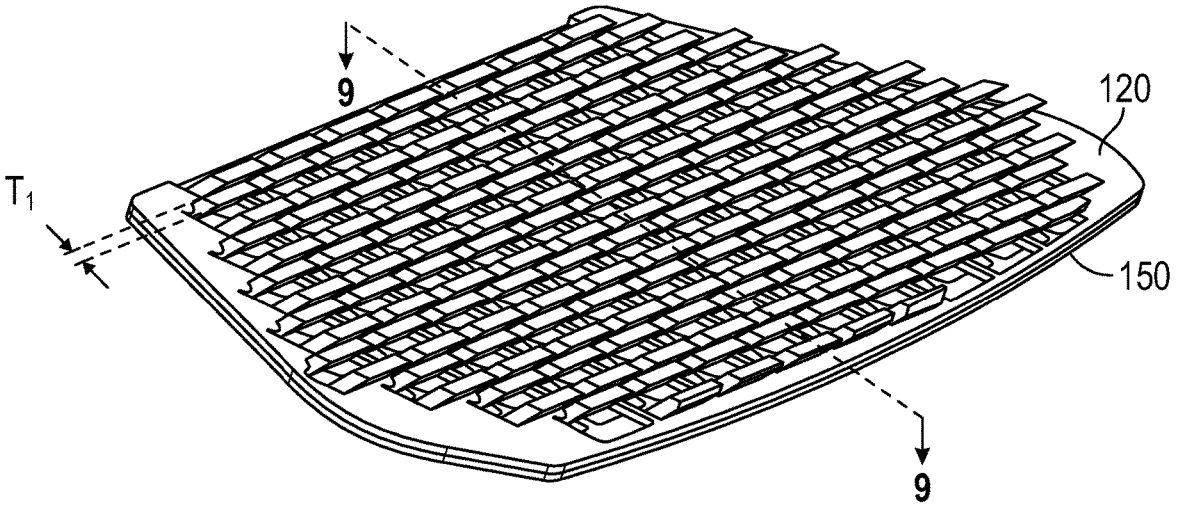
FIG. 5 is a side perspective view of the interlocking striking plates shown in FIG. 1.
Figure 9:
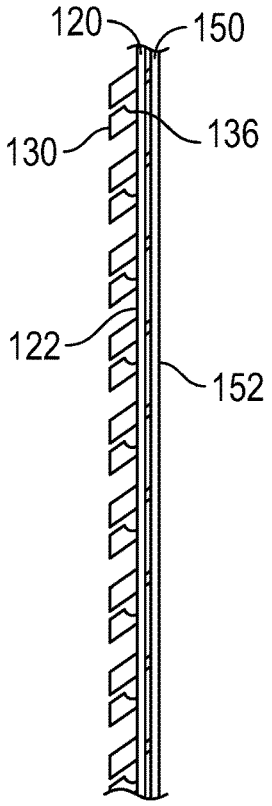
FIG. 9 is a cross-sectional view of the embodiment shown in FIG. 5 along lines 9-9.
Figure 10:
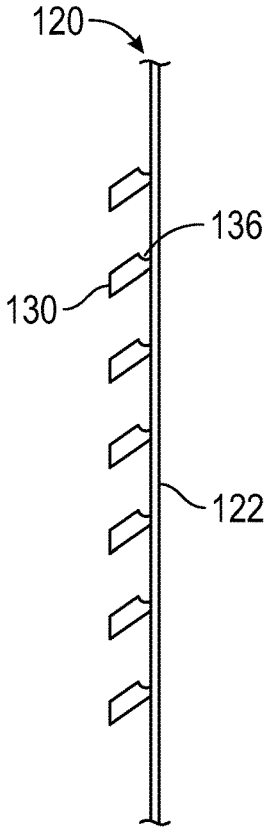
FIG. 10 is a cross-sectional view of the embodiment shown in FIG. 7 along lines 10-10.

As shown in FIGS. 5, 6, and 9, the first striking plate 120 is stacked on top of the second striking plate 150 so that each hinge feature 160 of the second striking plate 150 extends through a through hole 124 in the first striking plate 120, and so that most, if not all, of the hinge features 160 of the second striking plate 150 line up with a hinge feature 130 of the first striking plate 120. When stacked like this, each hinge feature 130, 160 is vertically spaced from neighboring hinge features by 0.005-0.010 inch, and horizontally by 0.025 to 0.075 inch. The connecting surfaces 137, 167 of the hinge features 130, 160 thereby combine to provide a striking surface that can make contact with a golf ball. The through holes 124, 154 of the first and second striking plates 120, 150 at least partially align when the plates 120, 150 are properly stacked so that the material forming the backing portion 110 can be injected molded or otherwise added to and around the plates 120, 150. Preferably, the material of the backing portion 110 is flush with the connecting surfaces 137, 167 of the hinge features when the face insert 100 is fully assembled.

When contacted by a golf ball, the tab portions 132, 162 are compressed downwards towards the base portion 122, 152, and provide the face insert 100 with additional elasticity, improving the topspin imparted to the golf ball compared with prior art inserts. The notches 136, 166 improve the bending properties of the tab portions 132, 162, allowing them to flex inwards and outwards more easily.

Several samples of the preferred embodiment shown in the Figures were placed in Odyssey #1 putters, all with 3° loft and 70° lie, and were tested using a putter robot at 3.50+/−0.05 mph under laboratory conditions. The resulting impact ratio, launch angle (°), and ball roll (rpm) data were compared against data collected under the same conditions from control putters having all of the same features as the test putters except for their face inserts, which were Odyssey White Hot inserts. As shown in Table 1, the inventive face insert reduced the impact ratio (or smash factor) of the putter by an average of 0.025, increased launch angle by an average of 0.20°, and added an average of 8.9 rpm to topspin.

TABLE 1

| | Impact Ratio | | Launch Angle [°] | | Ball Roll [rpm] | |
|---|---|---|---|---|---|---|
| Insert | Average | Std. Dev. | Average | Std. Dev. | Average | Std. Dev. |
| White Hot Sample 1 | 1.59 | 0 | 2.38 | 0.79 | 22.6 | 7.4 |
| White Hot Sample 2 | 1.61 | 0.01 | 4.02 | 0.29 | 30.0 | 3.1 |
| Stacked Microhinge Sample 1 | 1.56 | 0 | 2.26 | 0.65 | 32.3 | 7.9 |
| Stacked Microhinge Sample 2 | 1.56 | 0.01 | 2.57 | 0.47 | 35.1 | 8.1 |
| Stacked Microhinge Sample 3 | 1.58 | 0.01 | 3.99 | 0.44 | 38.1 | 3.7 |
| Stacked Microhinge Sample 4 | 1.59 | 0.01 | 4.4 | 0.51 | 35.0 | 0.3 |

Each striking plate 120, 150 preferably is composed of a metal alloy material such as stainless steel, titanium alloy, or aluminum alloy, though it may be composed of a rigid polymer material in alternative embodiments. When the striking plates 120, 150 are composed of one or more metal alloys, the hinge features 130, 160 and through-holes 124, 164 may be stamped, chemical etched, machined, and/or otherwise added to the respective striking plate 120, 150 by any means known to a person skilled in the art. The backing portion 110 preferably is composed of a polymer such as urethane, and preferably is co-molded or injection molded onto the striking plates 120, 150 so that the polymer material can flow over portions of the striking plates 120, 150, specifically the base portions 122, 152 and into the through-holes 124, 164 underneath the tab portions 132, 162. In alternative embodiments, however, the backing portion 110 may be permanently attached to one or both of the striking plates 120, 150 with an adhesive.

Though each of the face insert 100 embodiments disclosed herein are shown in connection with a putter head 10, these embodiments may be used with any other golf club head, including drivers, fairway woods, irons, wedges, and hybrids.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter comprising:

a body comprising a top portion, a sole portion, a toe side, a heel side, and a face side with a recess; and a face insert comprising a first striking plate and a second striking plate, wherein the first striking plate comprises a first base portion, a first plurality of hinge features extending at a first angle from the first base portion, and a first plurality of through-holes, and wherein each hinge feature of the first plurality of hinge features is disposed proximate to, and extends partially over, a through-hole of the first plurality of through-holes, wherein the second striking plate comprises a second base portion, a second plurality of hinge features extending at a second angle from the second base portion, and a second plurality of through-holes, and wherein each hinge feature of the second plurality of hinge features is disposed proximate to, and extends partially over, a through-hole of the second plurality of through-holes, wherein the first striking plate is stacked on the second striking plate so that at least a portion of the first base portion makes contact with at least a portion of the second base portion, so that each through-hole of the first plurality of through-holes at least partially overlaps a through-hole of the second plurality of through-holes, and so that each hinge feature of the second plurality of hinge features extends through a through-hole of the plurality of first through-holes, and wherein the face insert is disposed within the recess so that at least a portion of each hinge feature of the first and the second pluralities of hinge features is exposed.

2. The putter of claim 1, wherein the face insert further comprises a backing portion, wherein the backing portion contacts a rear surface of the first base portion.

3. The putter of claim 2, wherein the backing portion is affixed to and covers at least a portion of the first base portion and the second base portion.

4. The putter of claim 1, wherein each hinge feature of the first plurality of hinge features comprises a first tab portion with a first upper surface, a first lower surface, and a first connecting surface, wherein the first connecting surface is approximately parallel with the first base portion, and wherein each hinge feature of the second plurality of hinge features comprises a second tab portion with a second upper surface, a second lower surface, and a second connecting surface, wherein the second connecting surface is approximately parallel with the second base portion.

5. The putter of claim 4, wherein the first connecting surface is approximately parallel with the second connecting surface.

6. The putter of claim 5, wherein each of the first and the second connecting surfaces aligns with one another to create an approximately planar striking surface.

7. The putter of claim 4, wherein each of the first and the second tab portions has an approximately trapezoidal shape.

8. The putter of claim 4, wherein each hinge feature of the first plurality of hinge features extends at a first angle of 45-90° from the first base portion, and wherein each hinge feature of the second plurality of hinge features extends at a second angle of 45-90° from the second base portion.

9. The putter of claim 8, wherein the first angle is equivalent to the second angle.

10. The putter of claim 8, wherein each of the first and the second angles is 54-57°.

11. The putter of claim 4, wherein each hinge feature of the first plurality of hinge features comprises a notch extending into the first upper surface of the first tab portion at an intersection between the first tab portion and the first base portion.

12. The putter of claim 4, wherein each hinge feature of the second plurality of hinge features comprises a notch extending into the second upper surface of the second tab portion at an intersection between the second tab portion and the second base portion.

13. A putter comprising:

a body comprising a top portion, a sole portion, a toe side, a heel side, and a face side with a recess; and a face insert comprising a first metal striking plate, a second metal striking plate, and a polymeric backing portion, wherein the first metal striking plate comprises a first base portion, a first plurality of hinge features extending at a first angle from the first base portion, and a first plurality of through-holes, and wherein each hinge feature of the first plurality of hinge features is disposed proximate to, and extends partially over, a through-hole of the first plurality of through-holes, wherein the second metal striking plate comprises a second base portion, a second plurality of hinge features extending at a second angle from the second base portion, and a second plurality of through-holes, and wherein each hinge feature of the second plurality of hinge features is disposed proximate to, and extends partially over, a through-hole of the second plurality of through-holes, wherein the first striking plate is stacked on the second striking plate so that at least a portion of the first base portion makes contact with at least a portion of the second base portion, so that each through-hole of the first plurality of through-holes overlaps a through-hole of the second plurality of through-holes, and so that each hinge feature of the second plurality of hinge features extends through a through-hole of the plurality of first through-holes, wherein each hinge feature of the first plurality of hinge features comprises a first tab portion with a first upper surface, a first lower surface, and a first connecting surface, wherein the first connecting surface is approximately parallel with the first base portion, wherein each hinge feature of the second plurality of hinge features comprises a second tab portion with a second upper surface, a second lower surface, and a second connecting surface, wherein the second connecting surface is approximately parallel with the second base portion, wherein each of the first and the second connecting surfaces aligns with one another to create an approximately planar striking surface, and wherein the face insert is disposed within the recess so that each of the first and the second connecting surfaces of the plurality of the first and the second hinge features is exposed.

14. The putter of claim 13, wherein the backing portion is affixed to and covers both the first base portion and the second base portion.

15. The putter of claim 14, wherein the backing portion is composed of a urethane material.

16. The putter of claim 13, wherein each hinge feature of the first and the second pluralities of hinge features is vertically spaced from adjacent hinge features by 0.005 inch to 0.010 inch, and is horizontally spaced from adjacent hinge features by 0.025 inch to 0.075 inch.

17. The putter of claim 13, wherein each of the first and the second tab portions has a length of 0.025 inch to 0.100 inch, a width at least 1.5 times the length, and a thickness of 0.010 inch to 0.040 inch.

18. The putter of claim 13, wherein each of the first base portion and the second base portion has a thickness of 0.005 inch to 0.030 inch.

19. The putter of claim 13, wherein at least a portion of the backing portion is flush with each the first and the second connecting surfaces.

20. The putter of claim 13, wherein each of the first and the second tab portions has an approximately trapezoidal shape.

* * * * *